US008558645B2

(12) United States Patent
Hu et al.

(10) Patent No.: US 8,558,645 B2
(45) Date of Patent: Oct. 15, 2013

(54) APPARATUS FOR IMPROVING TRANSMISSION BANDWIDTH

(75) Inventors: Lihui Hu, Shenzhen (CN); Rui Yang, Shenzhen (CN); Shiping Cheng, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/310,408

(22) Filed: Dec. 2, 2011

(65) Prior Publication Data

US 2012/0075042 A1 Mar. 29, 2012

Related U.S. Application Data

(63) Continuation of application No. PCT/CN2010/079745, filed on Dec. 14, 2010.

(30) Foreign Application Priority Data

Dec. 26, 2009 (CN) ..... 2009 1 0189398

(51) Int. Cl.
*H01P 7/00* (2006.01)

(52) U.S. Cl.
USPC ..... 333/219; 333/200

(58) Field of Classification Search
USPC ..... 333/200, 219
See application file for complete search history.

(56) References Cited

U.S. PATENT DOCUMENTS

| | | | | |
|---|---|---|---|---|
| 3,593,208 | A * | 7/1971 | Smith | 333/112 |
| 4,600,907 | A * | 7/1986 | Grellman et al. | 333/246 |
| 5,485,131 | A * | 1/1996 | Fajen et al. | 333/202 |
| 5,777,532 | A * | 7/1998 | Lakin | 333/161 |
| 6,057,954 | A | 5/2000 | Parayanthal et al. | |
| 6,242,992 | B1 | 6/2001 | Lakin | |
| 7,061,949 | B1 | 6/2006 | Zhou et al. | |
| 2004/0070811 | A1 | 4/2004 | Matsushima et al. | |
| 2004/0207432 | A1 | 10/2004 | Otsuka et al. | |

FOREIGN PATENT DOCUMENTS

| | | | |
|---|---|---|---|
| CN | 1728448 | A | 2/2006 |
| CN | 1780045 | A | 5/2006 |
| CN | 101794929 | A | 8/2010 |
| WO | 03047025 | A1 | 6/2003 |
| WO | WO 2011076068 | A1 | 6/2011 |

OTHER PUBLICATIONS

International Search Report issued in corresponding PCT Patent Application No. PCT/CN2010/079745, mailed Mar. 24, 2011.

(Continued)

*Primary Examiner* — Robert Pascal
*Assistant Examiner* — Kimberly Glenn
(74) *Attorney, Agent, or Firm* — Conley Rose, P.C.; Grant Rodolph; Nicholas K. Beaulieu

(57) ABSTRACT

An apparatus for improving transmission bandwidth is provided in the embodiments of the present disclosure, which includes: a signal transmission line, side grounds located at two sides of the signal transmission line, and a capacitor disposed between the signal transmission line and the side grounds. The signal transmission line comprises a microstrip line, and the signal transmission line and the side grounds form a coplanar waveguide transmission line together. On a transmission channel connected through a bonding wire, a capacitor is disposed between a signal transmission line and side grounds. An inductor-capacitor (LC) resonance circuit is formed by using inductance characteristics presented by the bonding wire and the capacitor connected in parallel with the bonding wire, and a resonance point is formed within a frequency band in a frequency domain.

20 Claims, 5 Drawing Sheets

(56) References Cited

OTHER PUBLICATIONS

Office Action issued in corresponding Chinese Patent Application No. 200910189398.7, mailed Apr. 23, 2012.

Extended European Search Report issued in corresponding European Patent Application No. 10838631.9, mailed May 16, 2012.

Foreign Communication From a Counterpart Application, PCT Application PCT/CN2010/079745, English Translation of the Written Opinion dated Mar. 24, 2011, 5 pages.

* cited by examiner

APPARATUS FOR IMPROVING TRANSMISSION BANDWIDTH

CROSS-REFERENCE TO RELATED APPLICATIONS

This application is a continuation of International Application No. PCT/CN2010/079745, filed on Dec. 14, 2010, which claims priority to Chinese Patent Application No. 200910189398.7, filed on Dec. 26, 2009, both of which are hereby incorporated by reference in their entireties.

FIELD

The present disclosure relates to the field of electronic communications technologies, and in particular, to an apparatus for improving transmission bandwidth.

BACKGROUND

In a photoelectric conversion module of a conventional photoelectric component such as a Transmitter Optical Sub-Assembly (TOSA), a substrate and a package are connected through a bonding wire, thereby implementing signal transmission.

During the implementation of the present disclosure, the inventor finds that the prior art at least has the following defects.

As the bonding wire present certain inductance characteristics, the impedance of a transmission channel is discontinuous, and the transmission bandwidth is greatly restricted.

SUMMARY

Embodiments of the present disclosure provide an apparatus for improving transmission bandwidth, the apparatus is disposed on a transmission channel connected through a bonding wire, and a capacitor is disposed between a signal transmission line and side grounds, thereby expanding the bandwidth of the transmission channel.

Following are embodiments of the present disclosure.

An apparatus for improving transmission bandwidth includes: a signal transmission line, side grounds located at two sides of the signal transmission line, and a capacitor disposed between the signal transmission line and the side grounds, where the signal transmission line comprises a microstrip line, and the signal transmission line and the side grounds form a coplanar waveguide transmission line together.

A communication device includes a substrate, a package, and an apparatus for improving transmission bandwidth, where the apparatus for improving transmission bandwidth is disposed on the substrate or the package, or both the substrate and the package are disposed with the apparatus for improving transmission bandwidth; and the apparatus for improving transmission bandwidth includes: a signal transmission line, side grounds located at two sides of the signal transmission line, and a capacitor disposed between the signal transmission line and the side grounds, the signal transmission line comprises a microstrip line, and the signal transmission line and the side grounds form a coplanar waveguide transmission line together.

The embodiments have the following advantages.

In the embodiments of the present disclosure, on a transmission channel connected through a bonding wire, a capacitor is disposed between a signal transmission line and side grounds. An inductor-capacitor (LC) resonance circuit is formed by using inductance characteristics presented by the bonding wire and the capacitor connected in parallel with the bonding wire, and a resonance point is formed within a frequency band in a frequency domain, so that a rising trend of a return loss curve is forced to slow down, thereby expanding frequency bandwidth and further expanding bandwidth of a transmission channel of Radio Frequency (RF) signal.

BRIEF DESCRIPTION OF THE DRAWINGS

To illustrate the embodiments of the present disclosure or in the prior art more clearly, the accompanying drawings required for describing the embodiments or the prior art are introduced below briefly. Apparently, the accompanying drawings in the following descriptions merely show some of the embodiments of the present disclosure, and persons of ordinary skill in the art can obtain other drawings according to the accompanying drawings without creative efforts.

DETAILED DESCRIPTION OF THE EMBODIMENTS

The solutions of the present disclosure will be clearly and comprehensively described in the following with reference to the accompanying drawings. It is obvious that the embodiments to be described are only a part rather than all of the embodiments of the present disclosure. All other embodiments obtained by persons of ordinary skill in the art based on the embodiments of the present disclosure without creative efforts shall fall within the protection scope of the present disclosure.

Figure 1:
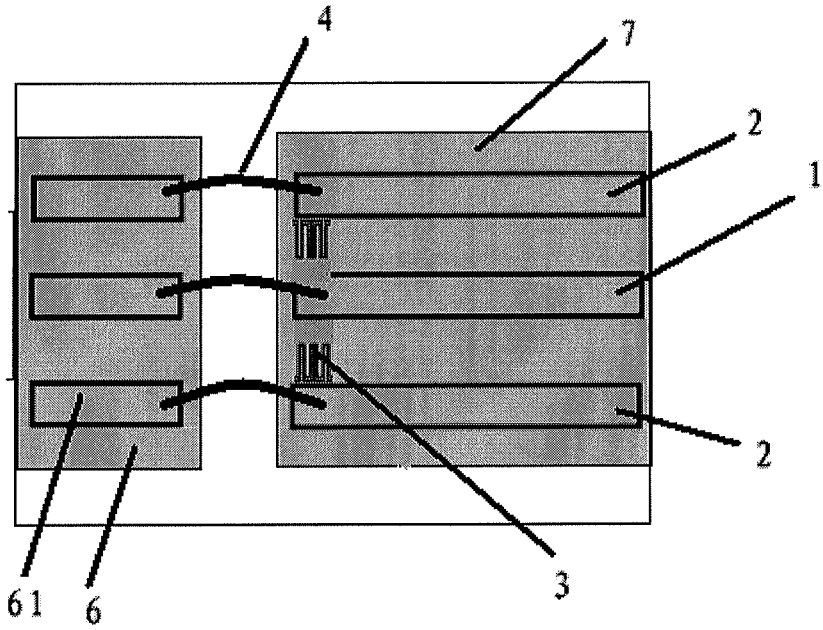
FIG. 1 is a schematic diagram of an apparatus for improving transmission bandwidth according to an embodiment of the present disclosure.

As shown in FIG. 1, an apparatus for improving transmission bandwidth according to an embodiment of the present disclosure includes: a signal transmission line 1, side grounds 2 located at two sides of the signal transmission line 1, and a capacitor 3 located between the signal transmission line 1 and the side grounds 2.

In the embodiment of the present disclosure, the signal transmission line may be a microstrip line, and the signal transmission line and the side grounds form a coplanar waveguide transmission line together.

Figure 2:
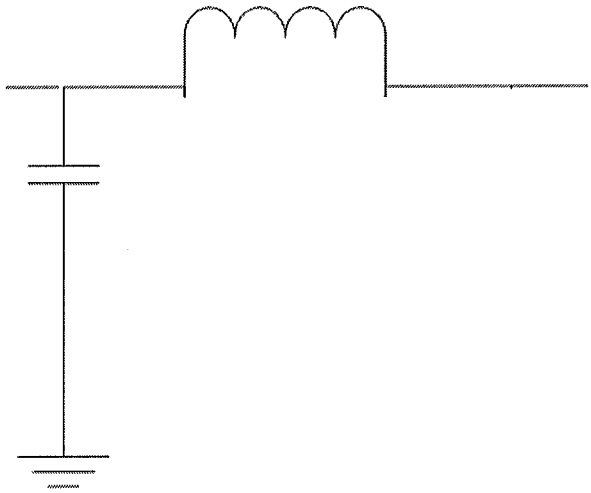
FIG. 2 is a schematic circuit diagram of an apparatus for improving transmission bandwidth according to the present disclosure.

The apparatus for improving transmission bandwidth according to the embodiment of the present disclosure may be applied to a transmission channel connected through a bonding wire. For example, as shown in FIG. 1, the signal transmission line 1 and the side grounds 2 are disposed on a substrate 7 having an optical component, an electric component or a photoelectric component, where the substrate 7 and a pad 61 of a package 6 are connected through a bonding wire 4. Referring to FIG. 2, FIG. 2 is a schematic circuit diagram of the apparatus for improving transmission bandwidth, the bonding wire 4 presents inductance characteristics and is equivalent to an inductor. By adding a capacitor with proper capacity at the substrate in a photoelectric component package or the pad in the package and connecting the capacitor in parallel to the ground, an LC resonance circuit is formed by using the inductance characteristics presented by the bonding wire 4 and the capacitor connected in parallel with the bonding wire 4, and a resonance point is formed within a frequency band in a frequency domain, so that a rising trend of a return loss curve is forced to slow down, thereby expanding frequency bandwidth and further expanding bandwidth of the transmission channel of a Radio Frequency (RF) signal. In this way, a higher signal transmission rate is achieved, and an insertion loss of the entire transmission channel is reduced at the same time (referring to FIG. 3).

Figure 4:
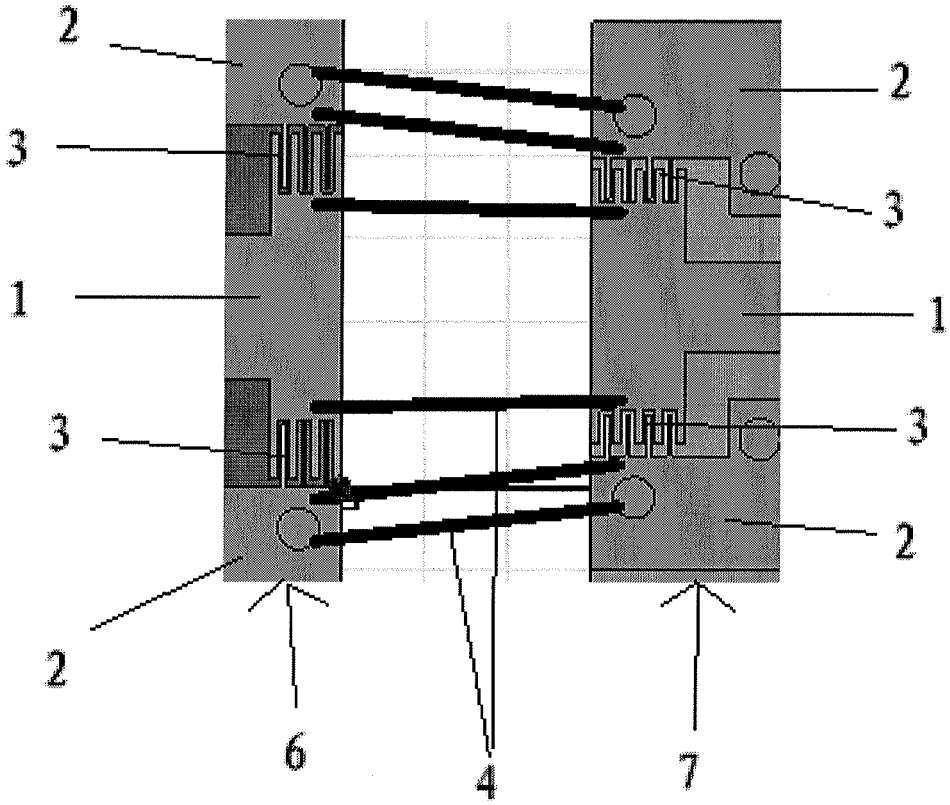
FIG. 4 is a schematic diagram of an apparatus for improving transmission bandwidth located on a substrate according to the present disclosure.

In the embodiment of the present disclosure, the pad of the package may be a pad of an electrical interface of the photoelectric component package. In addition, the signal transmission line and the side grounds may be disposed on the package, for example, the signal transmission line and the side grounds may be disposed on the pad inside the package. Alternatively, as shown in FIG. 4, the signal transmission line 1, the side grounds 2 and the capacitor 3 are disposed on the substrate 7, and moreover, the transmission line 1, the side grounds 2 and the capacitor 3 are also disposed on the package 6. The substrate 7 and the package 6 are connected through the bonding wire 4.

Figure 3:
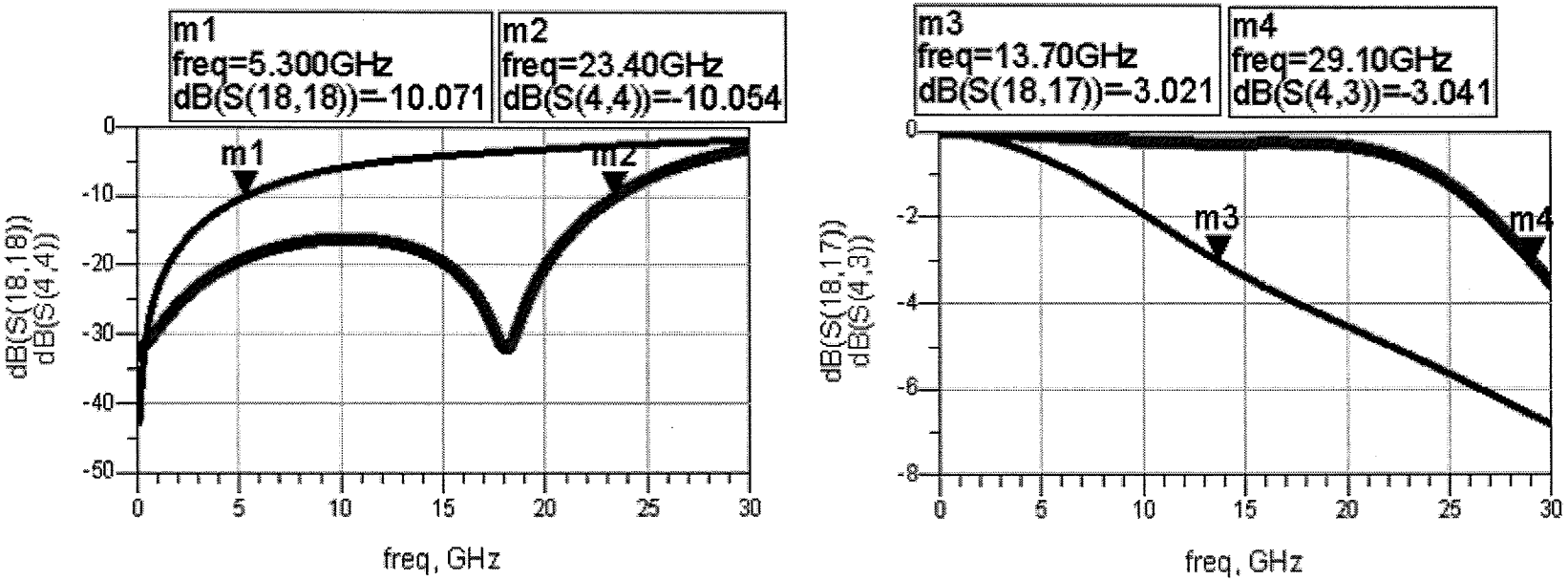
FIG. 3 is a schematic diagram of a return loss curve effect of an apparatus for improving transmission bandwidth according to the present disclosure.

FIG. 3 is a transmission channel connected through the bonding wire, and shows a change of a cut-off frequency point of a return loss of −10 dB before and after the capacitor is added, and a condition of insertion loss being reduced after the capacitor is adopted. In FIGS. 3, m1 and m3 are conditions that no capacitor is disposed; m2 and m4 are conditions that an interdigital capacitor is disposed. It can be seen from FIG. 3 that by disposing a capacitor, a return loss curve of the transmission channel forms a resonance point in a valid bandwidth, so that a cut-off frequency of the transmission channel with a return loss smaller than −10 dB is increased from 5.3 GHz to 23.4 GHz, thereby greatly expanding the transmission bandwidth, and further enabling the transmission channel to transmit a signal at a higher rate.

In the embodiment of the present disclosure, the capacitor may be a plate capacitor, an interdigital capacitor, an MIM capacitor, or a VIC.

Figure 5:
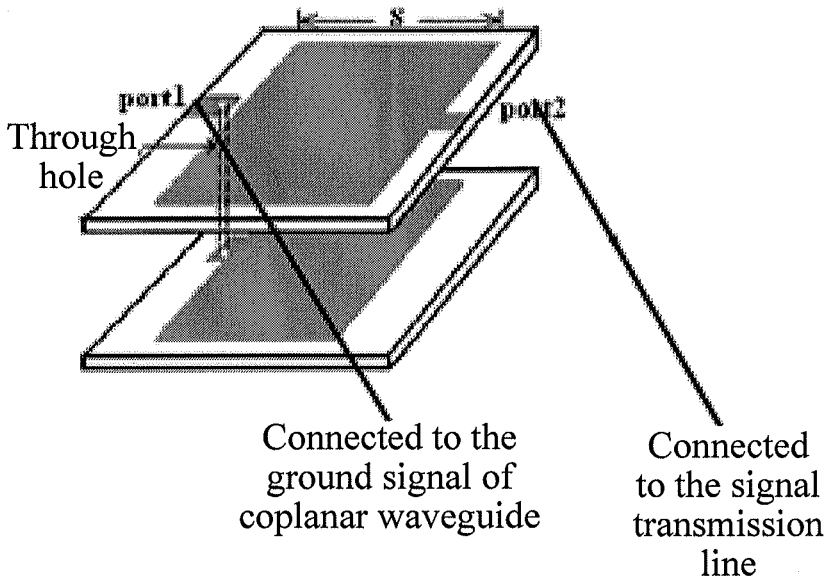
FIG. 5 is a schematic diagram of a Metal Insulation Metal (MIM) capacitor adopted in an apparatus for improving transmission bandwidth according to the present disclosure.

As shown in FIG. 5, when the capacitor is an MIM capacitor, the MIM capacitor includes a top layer metal surface and a bottom layer metal surface, where the top layer metal surface and the bottom layer metal surface are respectively disposed on two metal conductor layers inside the substrate, and the top layer metal surface is located at the same metal conductor layer with the signal transmission line. The bottom layer metal surface is connected to the top layer metal surface via a through hole, and is connected to the side grounds. The top layer metal surface is connected to the signal transmission line.

Figure 6:
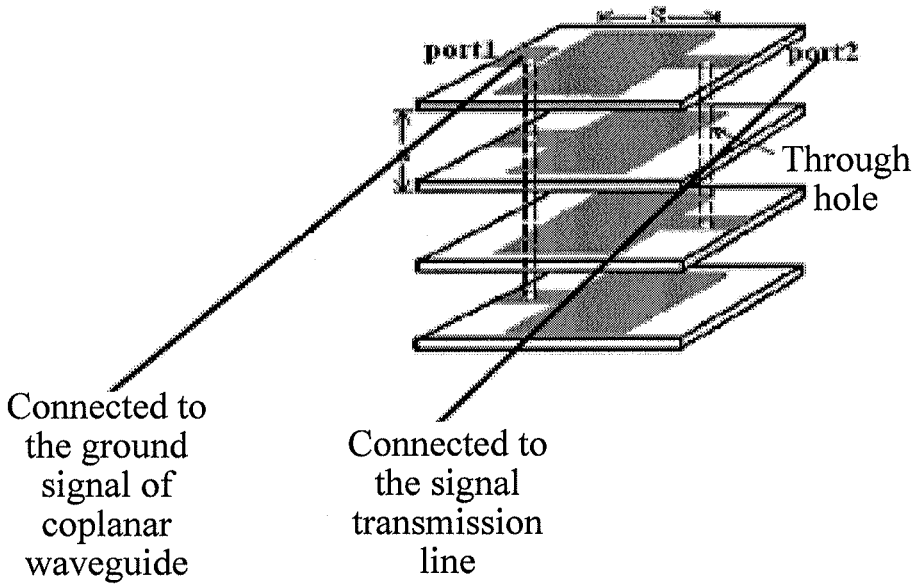
FIG. 6 is a schematic diagram of a Vertical Interdigital Capacitor (VIC) adopted in an apparatus for improving transmission bandwidth according to the present disclosure.

As shown in FIG. 6, when the capacitor is a VIC, the VIC includes multiple layers of metal surfaces. The multiple layers of metal surfaces overlap each other, and are respectively located on multiple metal conductor layers inside the substrate, where the multiple layers of metal surfaces that overlap each other form two electrodes of the VIC, and the metal surface on a top layer of the VIC is located at the same metal conductor layer with the signal transmission line. The multiple layers of metal surfaces located at one electrode of the VIC are connected via a through hole, and are connected to the side grounds; and the multiple layers of metal surfaces located at the other electrode of the VIC are connected to the metal surface on the top layer of the VIC via a through hole, and are connected to the signal transmission line.

In the embodiment of the present disclosure, the capacitor may be integrated inside the substrate, which does not increase the area or the cost of the substrate. Moreover, the capacitor does not need to be assembled subsequently, and the capacity of the capacitor does not change with change of the external environment.

In the embodiment of the present disclosure, when the capacitor is disposed between the signal transmission line and the side grounds, if the signal transmission line or a side ground is connected to a pad, the capacitor may be connected to the signal transmission line or the side ground by being connected to the pad, thereby forming an LC resonance circuit with the bonding wire connected to the pad. In this way, if the capacitor is connected to the pad, adding the capacitor may also increase the area of the pad of the bonding wire, so that when multiple bonding wires are disposed, the distance between the bonding wires may be further increased, and the total inductance of all bonding wires connected between the substrate and the package may be reduced, thereby further improving the bandwidth of the transmission channel.

Further, if the area of the pad of the bonding wire is increased, the operation and control can be carried out more conveniently, and an error is not easily incurred, when multiple bonding wires need to be connected.

Figure 7:
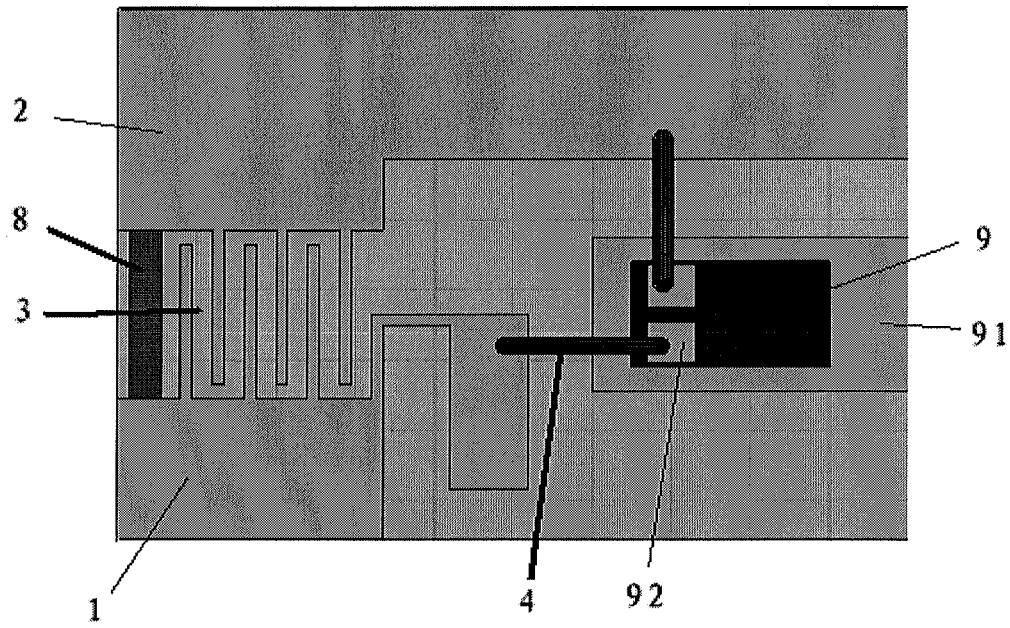
FIG. 7 is a schematic diagram of an application scenario of an apparatus for improving transmission bandwidth according to the present disclosure.

FIG. 7 shows another application scenario of an apparatus for improving transmission bandwidth according to an embodiment of the present disclosure. An optical component, an electric component or a photoelectric component 9 is disposed on a substrate, where the optical component, the electric component or the photoelectric component 9 is soldered to the substrate through a first pad 91, a second pad 92 of the optical component, the electric component or the photoelectric component 9 is connected to a signal transmission line 1 disposed on the substrate through a bonding wire 4, and a capacitor 3 is disposed between the signal transmission line 1 and side grounds 2, thereby expanding the transmission bandwidth. For example, when a matching resistor 8 on the substrate is away from the optical component 9 matched with the matching resistor 8, the matching resistor 8 and the optical component 9 are connected through the signal transmission line 1. Moreover, as the signal transmission line 1 and the second pad 92 (such as a signal pad) of the optical component 9 are not in the same plane, the signal transmission line 1 and the second pad 92 of the optical component 9 need to be connected through the bonding wire 4. At this time, the capacitor 3 may be disposed in parallel with the matching resistor 8 and disposed between the signal transmission line 1 and the side grounds 2, thereby expanding the bandwidth of the transmission channel.

Figure 8:
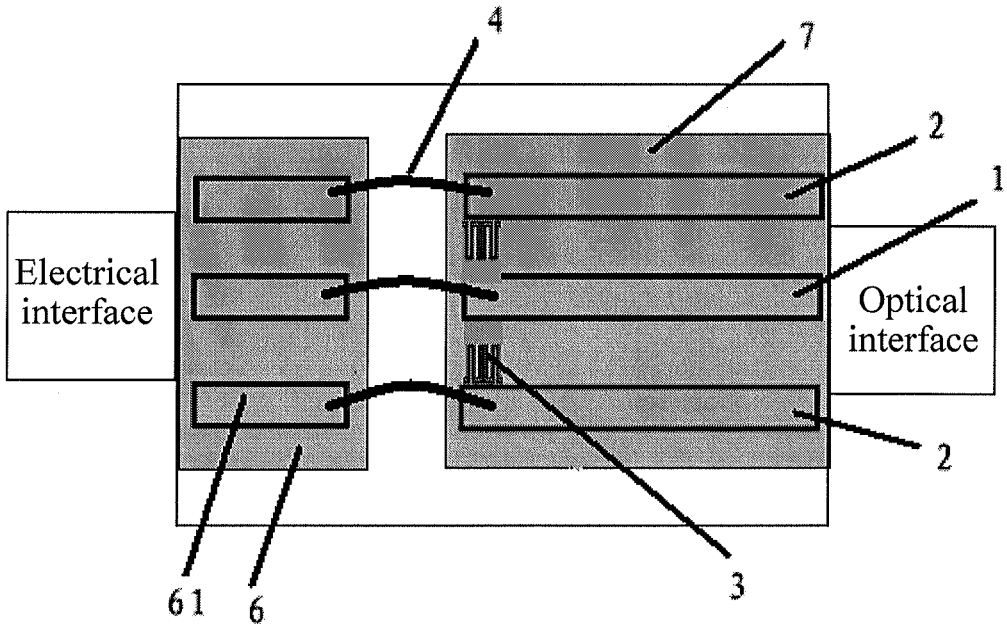
FIG. 8 is a schematic diagram of another application scenario of an apparatus for improving transmission bandwidth according to the present disclosure.

As shown in FIG. 8, the apparatus for improving transmission bandwidth according to the embodiment of the present disclosure may be disposed on a TOSA, a Receiver Optical Sub-Assembly (ROSA), a Bidirectional Optical Sub-Assembly (BOSA) or a Balance Receiver (BLRX) and so on. The TOSA, ROSA, BOSA or BLRX may be located on the following communication devices: a 10 Gigabit Small Form Factor Pluggable Module (XFP), a Small Form Factor Pluggable Module plus (SFP+), or a 300PIN transponder.

Only several embodiments of the present disclosure have been described above. Persons skilled in the art can make various modifications and variations to the present disclosure according to the disclosure of the application document without departing from the spirit and scope of the present disclosure.

What is claimed is:

1. An apparatus comprising:

a signal transmission line;

side grounds located at two sides of the signal transmission line; and a capacitor disposed between the signal transmission line and the side grounds, wherein the signal transmission line comprises a microstrip line, wherein the signal transmission line and the side grounds together form a coplanar waveguide transmission line, wherein the signal transmission line and the side grounds are disposed on a substrate, and wherein the substrate and a pad of a package are connected through a bonding wire.

2. The apparatus according to claim 1, wherein the pad is inside the package, wherein the signal transmission line and the side grounds are disposed on the pad inside the package, and wherein the pad inside the package and the substrate are connected through the bonding wire.

3. The apparatus according to claim 1, wherein the signal transmission line, the side grounds, and the capacitor are disposed on the substrate, wherein the signal transmission line, the side grounds, and the capacitor are also disposed on the package, and wherein the substrate and the package are connected through the bonding wire.

4. The apparatus according to claim 1, wherein the capacitor comprises an interdigital capacitor.

5. The apparatus according to claim 1, wherein the capacitor comprises a Metal Insulation Metal (MIM) capacitor, wherein the MIM capacitor comprises a top layer metal surface and a bottom layer metal surface, wherein the top layer metal surface and the bottom layer metal surface are respectively disposed on two metal conductor layers inside the substrate, wherein the top layer metal surface is located at the same metal conductor layer with the signal transmission line, wherein the bottom layer metal surface is connected to the top layer metal surface via a through hole and is connected to the side grounds, and wherein the top layer metal surface is connected to the signal transmission line.

6. The apparatus according to claim 1, wherein the capacitor comprises a Vertical Interdigital Capacitor (VIC), wherein the VIC comprises multiple layers of metal surfaces, wherein the multiple layers of metal surfaces overlap each other and are respectively located on multiple metal conductor layers inside the substrate, wherein the multiple layers of metal surfaces that overlap each other form two electrodes of the VIC, wherein the metal surface on a top layer of the VIC is located at the same metal conductor layer with the signal transmission line, wherein the multiple layers of metal surfaces located at one electrode of the VIC are connected via a through hole and are connected to the side grounds, and wherein the multiple layers of metal surfaces located at the other electrode of the VIC are connected to the metal surface on the top layer of the VIC via a through hole and are connected to the signal transmission line.

7. The apparatus according to claim 1, wherein the signal transmission line or one of the side grounds is connected to the pad, and wherein the capacitor is connected to the signal transmission line or the one of the side grounds by being connected to the pad.

8. The apparatus according to claim 1, wherein the substrate comprises an optical component, an electric component, or a photoelectric component, wherein the signal transmission line and the side grounds are disposed on the substrate comprising the optical component, the electric component, or the photoelectric component, wherein the optical component, the electric component, or the photoelectric component is soldered to the substrate through a first pad, and wherein a second pad of the optical component, the electric component, or the photoelectric component is connected to the signal transmission line through the bonding wire.

9. The apparatus according to claim 1, wherein the substrate comprises an optical component, an electric component, or a photoelectric component, wherein the signal transmission line and the side grounds are disposed on the substrate comprising the optical component, the electric component, or the photoelectric component, wherein a matching resistor is located on the substrate, wherein optical component is matched with the matching resistor, wherein the optical component and the matching resistor are connected through the signal transmission line, and wherein the signal transmission line and a second pad of the optical component are connected through the bonding wire.

10. A communication device comprising:

a substrate;

a package; and an apparatus, wherein the apparatus comprises a signal transmission line, side grounds located at two sides of the signal transmission line, and a capacitor disposed between the signal transmission line and the side grounds, wherein the signal transmission line comprises a microstrip line, wherein the signal transmission line and the side grounds together form a coplanar waveguide transmission line, wherein the apparatus is disposed on the substrate or the package, or, both the substrate and the package are disposed with the apparatus for improving transmission bandwidth, wherein the signal transmission line and the side grounds are disposed on the substrate, and wherein the substrate and a pad of the package are connected through a bonding wire.

11. The communication device according to claim 10, wherein the communication device is disposed with a Transmitter Optical Sub-Assembly (TOSA), a Receiver Optical Sub-Assembly (ROSA), a Bidirectional Optical Sub-Assembly (BOSA), or a Balance Receiver (BLRX), and wherein the substrate and the package are located on the TOSA, the ROSA, the BOSA, or the BLRX.

12. The apparatus according to claim 10, wherein the pad of the package is inside the package, wherein the signal transmission line and the side grounds are disposed on the pad inside the package, and wherein the pad inside the package and the substrate are connected through the bonding wire.

13. The apparatus according to claim 10, wherein the signal transmission line, the side grounds, and the capacitor are disposed on the substrate, wherein the signal transmission line, the side grounds, and the capacitor are also disposed on the package, and wherein the substrate and the package are connected through the bonding wire.

14. The apparatus according to claim 10, wherein the capacitor comprises an interdigital capacitor.

15. The apparatus according to claim 10, wherein the signal transmission line and the side grounds are disposed on the substrate, wherein the capacitor comprises a Metal Insulation Metal (MIM) capacitor, wherein the MIM capacitor comprises a top layer metal surface and a bottom layer metal surface, wherein the top layer metal surface and the bottom layer metal surface are respectively disposed on two metal conductor layers inside the substrate, wherein the top layer metal surface is located at the same metal conductor layer with the signal transmission line, wherein the bottom layer metal surface is connected to the top layer metal surface via a through hole and is connected to the side grounds, and wherein the top layer metal surface is connected to the signal transmission line.

16. The apparatus according to claim 10, wherein the signal transmission line and the side grounds are disposed on the substrate, wherein the capacitor comprises a Vertical Interdigital Capacitor (VIC), wherein the VIC comprises multiple layers of metal surfaces, wherein the multiple layers of metal surfaces overlap each other and are respectively located on multiple metal conductor layers inside the substrate, wherein the multiple layers of metal surfaces that overlap each other form two electrodes of the VIC, wherein the metal surface on a top layer of the VIC is located at the same metal conductor layer with the signal transmission line, wherein the multiple layers of metal surfaces located at one electrode of the VIC are connected via a through hole and are connected to the side grounds, and wherein the multiple layers of metal surfaces located at the other electrode of the VIC are connected to the metal surface on the top layer of the VIC via a through hole and are connected to the signal transmission line.

17. The apparatus according to claim 10, wherein the signal transmission line or one of the side grounds is connected to the pad, and wherein the capacitor is connected to the signal transmission line or the one of the side grounds by being connected to the pad.

18. The apparatus according to claim 10, wherein the substrate comprises an optical component, an electric component, or a photoelectric component, wherein the signal transmission line and the side grounds are disposed on the substrate comprising the optical component, the electric component, or the photoelectric component, wherein the optical component, the electric component, or the photoelectric component is soldered to the substrate through a first pad, and wherein a second pad of the optical component, the electric component, or the photoelectric component is connected to the signal transmission line through the bonding wire.

19. The apparatus according to claim 10, wherein the substrate comprises an optical component, an electric component, or a photoelectric component, wherein the signal transmission line and the side grounds are disposed on the substrate comprising the optical component, the electric component, or the photoelectric component, wherein a matching resistor is located on the substrate, wherein the optical component is matched with the matching resistor, wherein the optical component and the matching resistor are connected through the signal transmission line, and wherein the signal transmission line and a second pad of the optical component are connected through the bonding wire.

20. An apparatus comprising:

a signal transmission line;

side grounds located at two sides of the signal transmission line; and a capacitor disposed between the signal transmission line and the side grounds, wherein the signal transmission line comprises a microstrip line, wherein the signal transmission line and the side grounds together form a coplanar waveguide transmission line, wherein the signal transmission line and the side grounds are disposed on a pad inside a package; and wherein the pad inside the package and a substrate are connected through a bonding wire.

* * * * *

UNITED STATES PATENT AND TRADEMARK OFFICE

CERTIFICATE OF CORRECTION

PATENT NO. : 8,558,645 B2
APPLICATION NO. : 13/310408
DATED : October 15, 2013
INVENTOR(S) : Lihui Hu et al.

It is certified that error appears in the above-identified patent and that said Letters Patent is hereby corrected as shown below:

In the Claims:

Column 6, lines 16-27, printed claim 9, should read as:

9. The apparatus according to claim 1, wherein the substrate comprises an optical component, an electric component, or a photoelectric component, wherein the signal transmission line and the side grounds are disposed on the substrate comprising the optical component, the electric component, or the photoelectric component, wherein a matching resistor is located on the substrate, wherein the optical component is matched with the matching resistor, wherein the optical component and the matching resistor are connected through the signal transmission line, and wherein the signal transmission line and a second pad of the optical component are connected through the bonding wire.

Signed and Sealed this
Twenty-sixth Day of November, 2013

Margaret A. Focarino

Margaret A. Focarino
*Commissioner for Patents of the United States Patent and Trademark Office*